US007006050B2

(12) United States Patent
Aisenbrey

(10) Patent No.: US 7,006,050 B2
(45) **Date of Patent: *Feb. 28, 2006**

(54) LOW COST ANTENNAS MANUFACTURED FROM CONDUCTIVE LOADED RESIN-BASED MATERIALS HAVING A CONDUCTING WIRE CENTER CORE

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 49 days.

This patent is subject to a terminal disclaimer.

(21) Appl. No.: 10/799,103

(22) Filed: Mar. 12, 2004

(65) Prior Publication Data

US 2004/0174318 A1 Sep. 9, 2004

Related U.S. Application Data

(63) Continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/456,970, filed on Mar. 24, 2003, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.
*H01Q 9/04* (2006.01)
*H01Q 9/16* (2006.01)

(52) U.S. Cl. ..... 343/791; 343/792

(58) Field of Classification Search ..... 343/791, 343/792, 790, 700 MS, 846; H01Q 9/04, H01Q 9/16

See application file for complete search history.

(56) References Cited

U.S. PATENT DOCUMENTS 4,008,477 A 2/1977 Babij et al. ..... 343/701

(Continued)

FOREIGN PATENT DOCUMENTS

EP 1233426 A 2/2002

(Continued)

OTHER PUBLICATIONS

U.S. Appl. No. 10/780,214, filed Feb. 17, 2004, assigned to the same assignee, "Low Cost Antennas and Electromagnetic (EMF) Absorption in Electronic Circuit Packages or Transceivers Using Conductive Loaded Resin-Based Materials".

*Primary Examiner*—Hoanganh Le
(74) *Attorney, Agent, or Firm*—George O. Saile; Stephen B. Ackerman; Larry J. Prescott

(57) ABSTRACT

Low cost moldable antennas and methods of forming the antennas are described. Elements of the antennas are conductive loaded resin-based material having a conducting wire center. The conducting wire center can be single strand, multi-strand, insulated, or non-insulated wire. The conductive loaded resin-based material comprises micron conductor fibers, micron conductor powders, or in combination thereof homogenized within a base resin host wherein the ratio of the weight of the conductor fibers, conductor powders, or combination thereof to the weight of the base resin host is typically between about 0.20 and 0.40. The micron conductive fibers or powders can be stainless steel, nickel, copper, silver, carbon, graphite, or plated particles or fibers, or the like. The conducting metal wire can be copper, nickel, stainless steel, silver, or the like. Antennas can be fabricated using methods such as injection molding, over-molding, thermo-set, protrusion, extrusion, co-extrusion, compression, or the like to achieve desired electrical characteristics. The elements of the antennas can be virtually any shape or size desired. The conductive loaded resin-based material having a conducting wire center provides very efficient antenna operation.

35 Claims, 5 Drawing Sheets

U.S. PATENT DOCUMENTS

| | | | | |
|---|---|---|---|---|
| 4,134,120 | A | 1/1979 | DeLoach et al. | 343/715 |
| 5,554,997 | A | 9/1996 | Cobb | 343/793 |
| 5,635,943 | A | 6/1997 | Grunwell | 343/702 |
| 5,771,027 | A | 6/1998 | Marks et al. | 343/912 |
| 6,249,261 | B1 | 6/2001 | Solberg, Jr. et al. | 343/801 |
| 6,317,102 | B1 | 11/2001 | Stambeck | 343/900 |
| 6,320,753 | B1 | 11/2001 | Launay | 361/760 |
| 6,356,234 | B1 | 3/2002 | Harrison et al. | 343/700 MS |
| 6,486,853 | B1 | 11/2002 | Yoshinomoto et al. | 343/895 |
| 6,531,983 | B1 | 3/2003 | Hirose et al. | 343/700 MS |
| 6,617,976 | B1 | 9/2003 | Walden et al. | 340/870.02 |
| 6,870,516 | B1 * | 3/2005 | Aisenbrey | 343/873 |

FOREIGN PATENT DOCUMENTS

| | | | |
|---|---|---|---|
| GB | 2377449 | A | 1/2003 |
| JP | 56064502 | | 6/1981 |
| JP | 57166702 | | 10/1982 |
| JP | 03044203 | | 2/1991 |

* cited by examiner

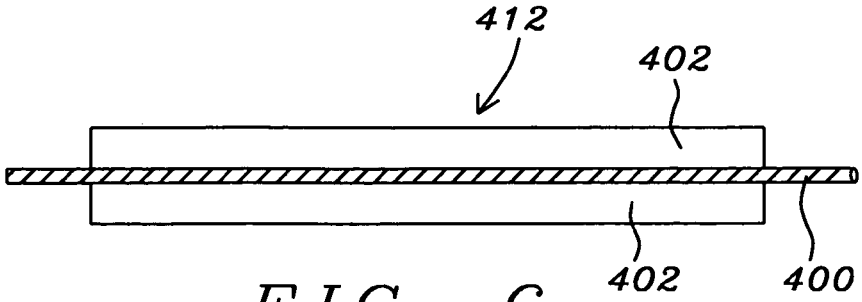
FIG. 6
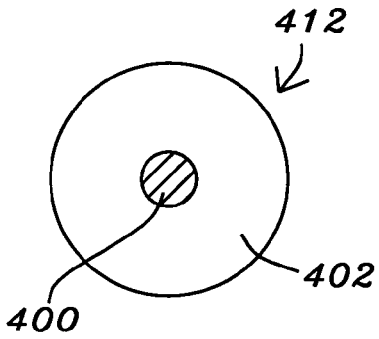
FIG. 7A
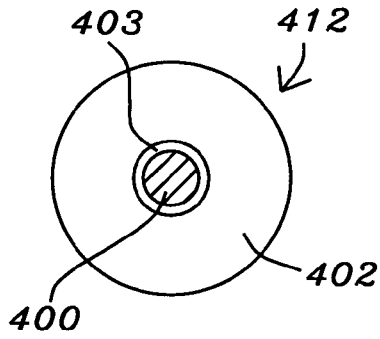
FIG. 7B
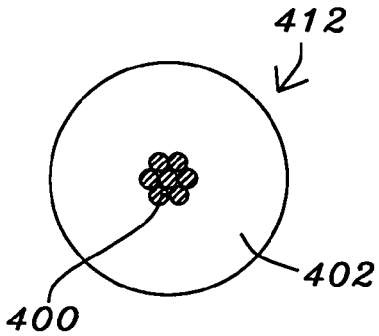
FIG. 7C
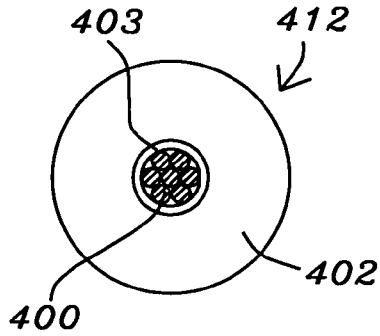
FIG. 7D
FIG. 8
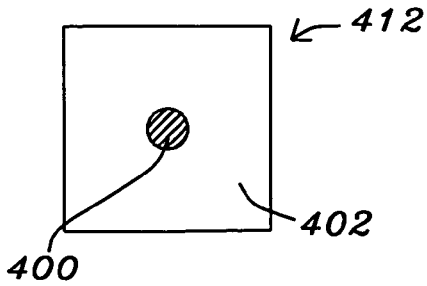

LOW COST ANTENNAS MANUFACTURED FROM CONDUCTIVE LOADED RESIN-BASED MATERIALS HAVING A CONDUCTING WIRE CENTER CORE

This Patent Application claims priority to U.S. Provisional Patent Application 60/456,970, filed Mar. 24, 2003.

This Patent Application is a Continuation-in-Part of INT01-002CIP, filed as U.S. patent application Ser. No. 10/309,429, filed on Dec. 4, 2002, now U.S. Pat. No. 6,870,516 also incorporated by reference in its entirety, which is a Continuation-in-Part Application of docket number INT01-002, filed as U.S. patent application Ser. No. 10/075,778, filed on Feb. 14, 2002, now U.S. Pat. No. 6,741,221 which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to antennas molded of conductive loaded resin-based materials comprising micron conductive powders or micron conductive fibers or in combination thereof, homogenized within a base resin when molded and having a conducting wire center or core. This yields a conductive part or material usable within the EMF or electronic spectrum(s).

(2) Description of the Related Art

Antennas are an essential part of electronic communication systems that contain wireless links. Low cost antennas offer significant advantages for these systems.

U.S. Pat. No. 5,771,027 to Marks et al. describes a composite antenna having a grid comprised of electrical conductors woven into the warp of a resin reinforced cloth forming one layer of a multi-layer laminate structure of an antenna.

U.S. Pat. No. 6,249,261 B1 to Solberg, Jr. et al. describes a direction-finding material constructed from polymer composite materials which are electrically conductive.

U.S. Pat. No. 4,134,120 to DeLoach et al. describes antennas formed from fiber reinforced resin material.

U.S. Pat. No 6,531,983 B1 to Hirose et al. describes a dielectric antenna wherein a circuit pattern is formed of a conductive film or resin.

U.S. Pat. No. 6,320,753 B1 to Launay describes forming an antenna using silk-screen printing of a conductive ink or a conductive resin.

U.S. Pat. No. 6,617,976 B1 to Walden et al. teaches, without providing details, that an antenna could be formed of conductive plastics.

U.S. Pat. No. 6,486,853 B2 to Yoshinomoto et al. describe an antenna having a conductor wound on an insulating core body. The insulating core body can be formed using extrusion. There is no wire within the core body.

U.S. Pat. No. 6,317,102 to Stambeck describes an antenna unit having an insulating jacket formed over a metallic core, such as a wire.

U.S. Pat. No. 5,635,943 to Grunwell describes an antenna containing an antenna element having a conducting core surrounded by an insulating sheath. The conducting core can be a rigid rod or a wound wire semi-rigid coil. The insulating sheath can be a plastic film applied to the conduction core by extrusion.

Patent application Ser. No. 10/780,214; filed Feb. 17, 2004; entitled "Low Cost Antennas and Electromagnetic (EMF) Absorption in Electronic circuit Packages or Transceivers Using Conductive Loaded Resin-Based Materials" and assigned to the same assignee describe low cost antennas and electromagnetic absorption structures using conductive loaded resin-based materials.

SUMMARY OF THE INVENTION

Antennas are an essential part of electronic circuitry, such as electronic communication systems that contain wireless links. Lowering the cost and improving the manufacturing capabilities for antennas provides an important advantage for these systems. Low cost molded antennas offer significant advantages for these systems not only from a fabrication standpoint, but also characteristics related to 2D, 3D, 4D, and 5D electrical characteristics, which include the physical advantages that can be achieved by the molding process of the actual parts and the polymer physics within the conductive networks formed within the molded part.

It is a principle objective of this invention to provide low cost, high performance, and efficient molded antennas of conductively loaded resin-based material and having a conducting wire center or core. The antennas are fabricated from molded conductive loaded resin-based materials, comprising micron conductive fibers, micron conductive powders, or in combination thereof, that are homogenized within a base resin host in a molding process and have a conducting wire center or core.

It is another principle objective of this invention to provide a method of fabricating low cost, high performance, and efficient molded antennas of conductively loaded resin-based material having a conducting wire center or core. The antennas are fabricated from molded conductive loaded resin-based materials comprising micron conductive fibers, micron conductive powders, or in combination thereof, that are homogenized within a base resin during the molding process and have a conducting wire center or core.

These objectives are achieved by molding the antennas from conductive loaded resin-based materials around a conducting wire center. These conductive loaded resin-based materials are resins loaded with conductive materials to provide a resin-based material, which is a conductor rather than an insulator. The resins provide the structural material which; when loaded with micron conductive powders, micron conductive fibers, or any combination thereof, become composites which are conductors rather than insulators. The orientation of micron conductive fibers, micron conductive powders or in combination thereof, homogenized within the base resin may be tightly controlled in the molding process. Various desired electrical and EMF characteristics may be achieved during the molding and mix process. The conducting wire center can be any metal wire, such as copper, nickel, stainless steel, silver or the like. The wire can be single strand, multi strand, insulated, or non-insulated depending on desired electrical characteristics.

These conductive loaded resin-based materials can be molded around a conducting wire center into any number of desired shapes and sizes using methods such as injection molding, over-molding, thermo-set, protrusion, extrusion, co-extrusion, compression, or the like. The conducting wire center can be single strand, multi-strand, insulated, or non-insulated wire. The method, wire gages, and/or wire types are chosen to achieve the desired electrical characteristics for an antenna. The conductive loaded resin-based material could also be a molded part, sheet, bar stock, or the like that may be cut, stamped, milled, laminated, vacuumed formed, or the like, formed around a conducting wire center, to provide the desired shape and size of this element or part. The characteristics of the antenna elements depend on the wire gages and/or types and on the composition of the conductive loaded resin-based materials, which can be adjusted and tightly controlled in achieving the desired characteristics of the molded material.

BRIEF DESCRIPTION OF THE DRAWINGS

FIG. 6 shows a longitudinal cross section view of the conductive loaded resin-based material of FIG. 5 having a conducting wire center.

FIG. 7A shows a transverse cross section view of the conductive loaded resin-based material of FIG. 5 having a single strand, non-insulated conducting wire center and a circular cross section.

FIG. 7B shows a transverse cross section view of the conductive loaded resin-based material of FIG. 5 having a single strand, insulated conducting wire center and a circular cross section.

FIG. 7C shows a transverse cross section view of the conductive loaded resin-based material of FIG. 5 having a multi-strand, non-insulated conducting wire center and a circular cross section.

FIG. 7D shows a transverse cross section view of the conductive loaded resin-based material of FIG. 5 having a multi-strand, insulated conducting wire center and a circular cross section.

FIG. 8 shows a transverse cross section view of the conductive loaded resin-based material of FIG. 5 having a conducting wire center and a rectangular cross section.

DESCRIPTION OF THE PREFERRED EMBODIMENTS

Figure 1A:
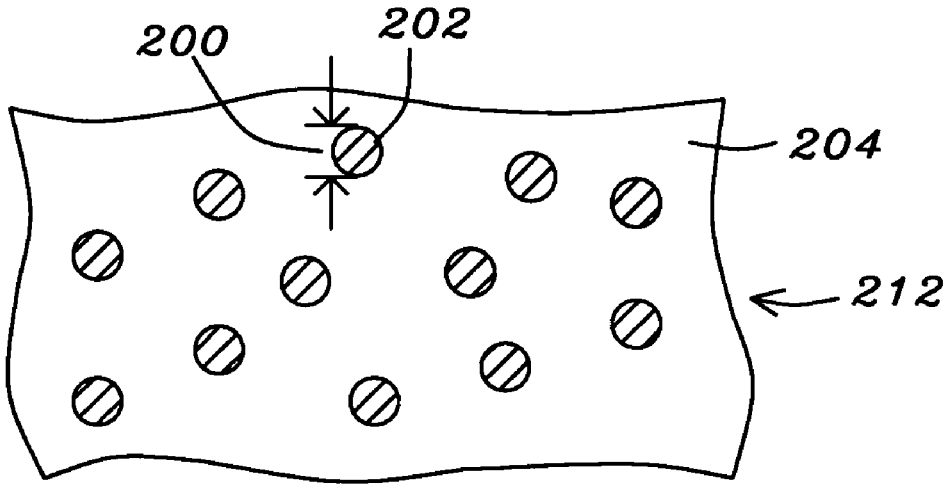
FIG. 1A shows a cross section view of a conductive loaded resin-based material comprising a powder of conductor materials.

This invention relates to antennas molded of conductive loaded resin-based materials comprising micron conductive powders, micron conductive fibers, or a combination thereof, homogenized within a base resin when molded and having a conducting wire center core.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded, co-extruded, or the like to provide almost any desired shape or size. The molded conductive loaded resin-based materials can also be cut, stamped or vacuumed formed from injection molded, extruded, co-extruded, sheet or bar stock, over-molded, laminated, milled or the like to provide the desired antenna shape and size. The electrical characteristics of antennas fabricated using conductive loaded resin-based materials, depend on the composition of the conductive loaded resin-based materials, of which the loading or doping parameters can be adjusted, to aid in achieving the desired structural, electrical or other physical characteristics of the material. The selected materials used to build the antennas are homogenized together using molding techniques and/or methods such as injection molding, overmolding, thermo-set, protrusion, extrusion, co-extrusion, or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of antennas significantly lowers the cost of materials and the design and manufacturing processes used to hold close tolerances, by forming these materials into desired shapes and sizes. The antennas can be manufactured into infinite shapes and sizes using conventional forming methods such as injection molding, overmolding, or extrusion, co-extrusion, or the like.

The conductive loaded resin-based materials when molded typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or in any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or overmolding, extrusion, or co-extrusion to create desired shapes and sizes. The molded conductive loaded resin-based materials can also be stamped, cut or milled as desired to create the desired form factor(s) of the antennas. The doping composition and directionality associated with the micron conductors within the loaded base resins can affect the electrical and structural antenna characteristics, and can be precisely controlled by mold designs, gating and or protrusion design(s) and or during the molding process itself.

A resin based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or single strand material, which when discretely designed in fiber content(s), orientation(s) and shape(s), will produce a very highly conductive flexible cloth-like material.

Such a cloth-like antenna could be embedded in a person's clothing as well as other resin materials such as rubber(s) or plastic(s). When using conductive fibers as a webbed conductor as part of a laminate or cloth-like material the fibers may have diameters of between about 3 and 12 microns, typically between about 8 and 12 microns or in the range of about 10 microns, with length(s) that can be seamless or overlapping.

Figure 1B:
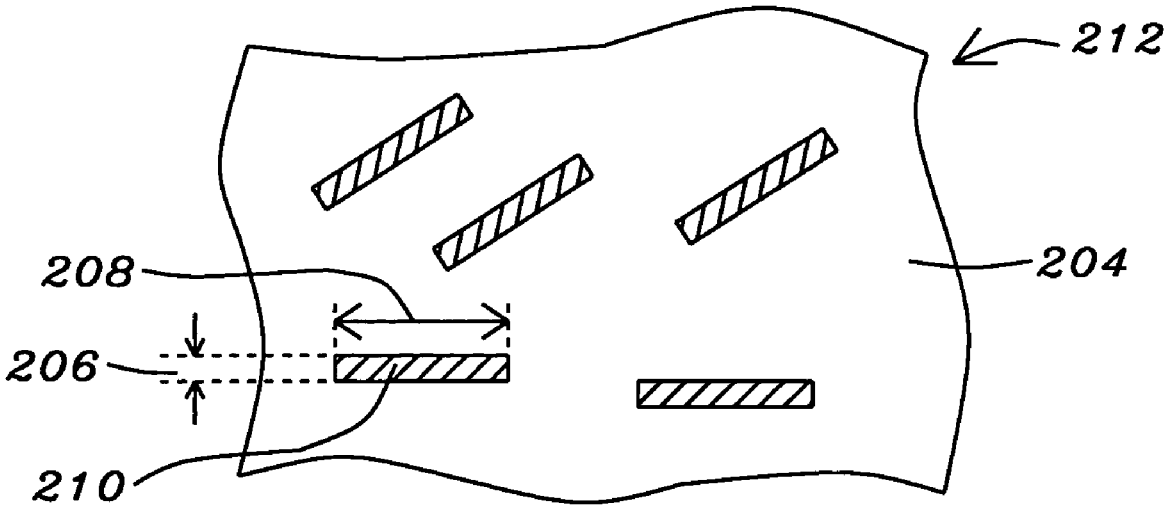
FIG. 1B shows a cross section view of a conductive loaded resin-based material comprising conductor fibers.
Figure 1C:
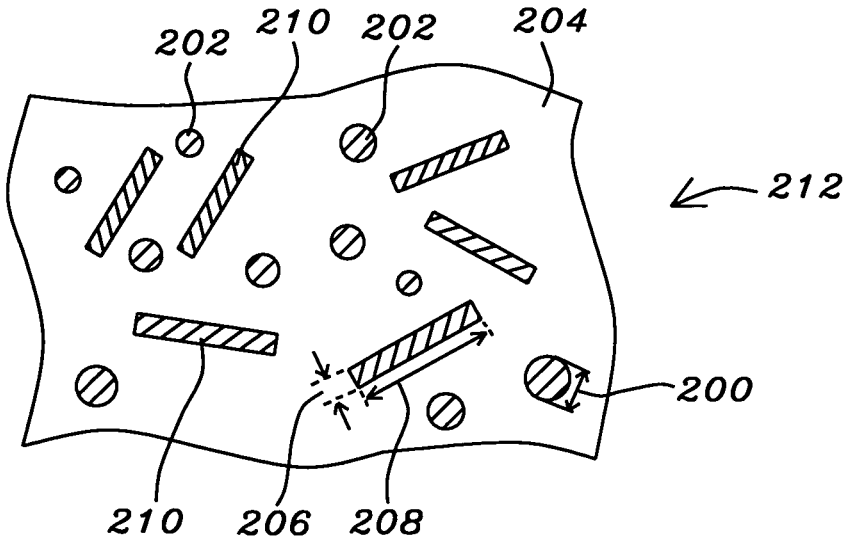
FIG. 1C shows a cross section view of a conductive loaded resin-based material comprising both micron conductor powder and micron conductor fibers.

The conductive loaded resin-based material typically comprises a micron powder(s) of conductor particles, micron conductor fiber(s), or in combination thereof homogenized within a base resin host. FIG. 1 A shows cross section view of an example of conductor loaded resin-based material 212 having a powder of conductor particles 202 in a base resin host 204. In this example the diameter 200 of the conductor particles 202 in the powder is between about 3 and 12 microns. FIG. 1B shows a cross section view of an example of conductor loaded resin-based material 212 having conductor fibers 210 in a base resin host 204. The conductor fibers 210 have a diameter 206 of between about 3 and 12 microns, typically in the range of 10 microns or between about 8 and 12 microns, and a length 208 of between about 2 and 14 millimeters. FIG. 1C shows a cross section view of an example of conductor loaded resin based material 212 having both a powder of conductor particles 202 and conductor fibers 210 in a base resin host 204. In this example the diameter 200 of the conductor particles 202 in the powder is between about 3 and 12 microns and the conductor fibers 210 have a diameter 206 of between about 3 and 12 microns, typically in the range of 10 microns or between about 8 and 12 microns, and a length 208 of between about 2 and 14 millimeters.

The conductors used for these conductor particles 202 or conductor fibers 210 can be stainless steel, nickel, copper, silver, or other suitable metals or conductive fibers, or combinations thereof. These conductor particles and/or fibers are homogenized within a base resin. As previously mentioned, the conductive loaded resin-based materials have a resistivity between about 5 and 25 ohms per square, but other resistivities can be achieved by varying the doping parameters and/or resin selection. To realize this resistivity the ratio of the weight of the conductor material, in this example the conductor particles 202 and/or conductor fibers 210, to the weight of the base resin host 204 is between about 0.20 and 0.40, and is preferably about 0.30. Stainless Steel Fiber of 8–11 micron in diameter and lengths of 4–6 mm with a fiber weight to base resin weight ratio of 0.30 will produce a very highly conductive parameter, efficient within any EMF spectrum.

Figure 2:
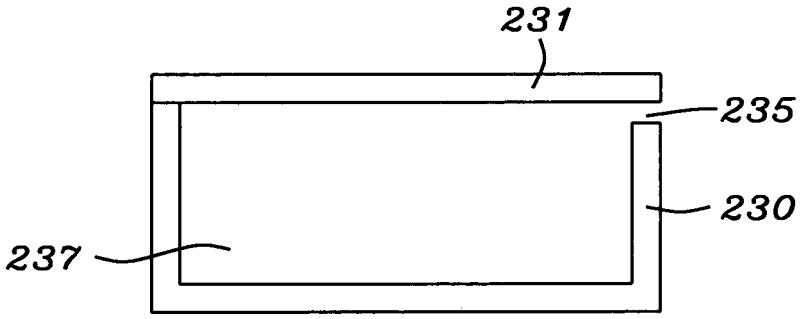
FIG. 2 shows a simplified schematic view of an apparatus for forming injection molded parts.

Electronic elements, antenna elements, or EMF absorbing elements formed from conductive loaded resin-based materials can be formed or molded in a number of different ways including injection molding, extrusion, co-extrusion, or chemically induced molding or forming. FIG. 2 shows a simplified schematic diagram of an injection mold showing a lower portion 230 and upper portion 231 of the mold. Raw material conductive loaded blended resin-based material is injected into the mold cavity 237 through an injection opening 235 and the then homogenized conductive material cures by thermal reaction. The upper portion 231 and lower portion 230 of the mold are then separated or parted and the conductive antenna element is removed.

Figure 3:
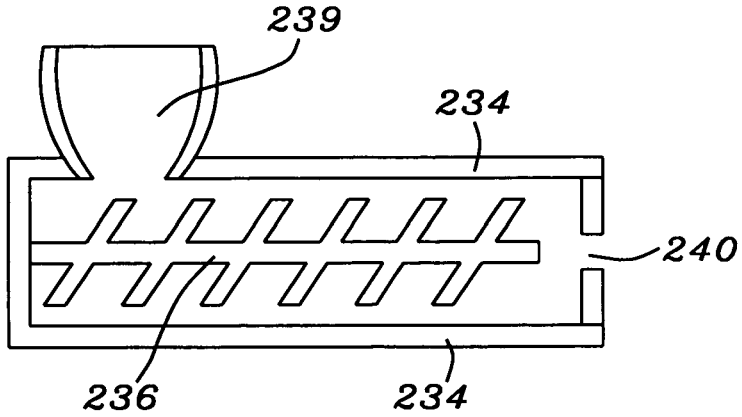
FIG. 3 shows a simplified schematic view of an apparatus for forming extruded or co-extruded parts.

FIG. 3 shows a simplified schematic diagram of an extruder for forming antenna elements using extrusion or co-extrusion. Raw material(s) conductive loaded resin-based material is placed in the hopper 239 of the extrusion or co-extrusion unit which feeds the material into the barrel 234. A piston, screw, press or other means, a screw 236 is shown in the example shown in FIG. 3, is then used to force the thermally molten or a chemically induced curing conductive loaded resin-based material through an extrusion opening 240, which shapes the thermally molten curing or chemically induced cured conductive loaded resin-based material to the desired shape. The conductive loaded resin-based material is then fully cured by chemical reaction or thermal reaction to a hardened or pliable state and is ready for use.

Figure 4A:
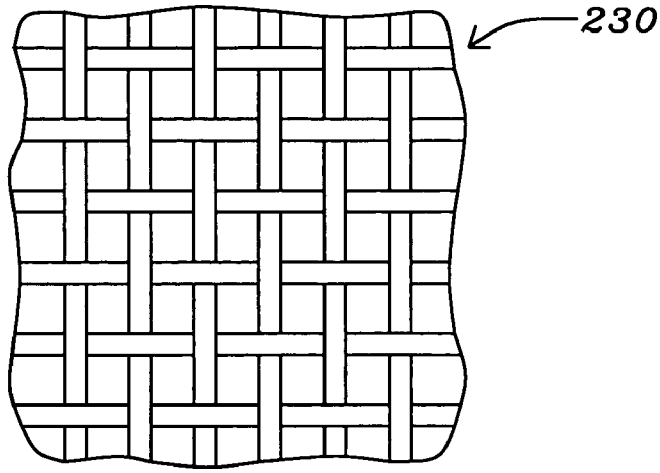
FIG. 4A shows a top view of fibers of conductive loaded resin-based material woven into a conductive fabric.
Figure 4B:
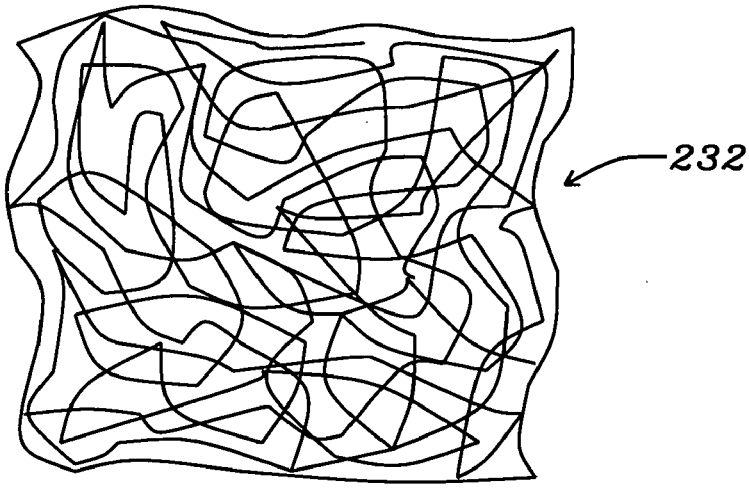
FIG. 4B shows a top view of fibers of conductive loaded resin-based material randomly webbed into a conductive fabric.

Referring now to FIGS. 4A and 4B, a preferred composition of the conductive loaded, resin-based material is illustrated. The conductive loaded resin based material can be formed into fibers or textiles that are then woven or webbed into a conductive fabric. The conductive loaded resin-based material is formed in strands that can be woven as shown. FIG. 4A shows a conductive fabric 230 where the fibers are woven together in a two-dimensional weave of fibers or textiles. FIG. 4B shows a conductive fabric 232 where the fibers are formed in a webbed arrangement. In the webbed arrangement, one or more continuous strands of the conductive fiber are nested in a random fashion. The resulting conductive fabrics or textiles 230, see FIG. 4A, and 232, see FIG. 4B, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 5:
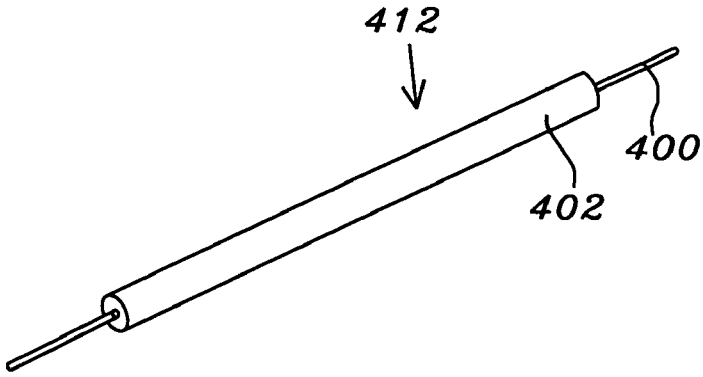
FIG. 5 shows a perspective view of conductive loaded resin-based material having a conducting wire center.

Refer now to FIGS. 5–11 for a description of antennas of this invention fabricated by molding conductive loaded resin based materials around a conducting wire center. The conducting wire center can be single strand wire, multi-strand wire, insulated wire, or non-insulated wire. FIG. 5 shows a perspective view of a segment of an antenna element 412 of conductive loaded resin-based material 402 molded around a conducting wire 400 center. The conducting wire 400 makes the conductive loaded resin-based material even more effective as antenna elements. The conductive loaded resin-based material, having a conducting wire center, antenna elements 412 can be molded by methods such as extrusion, co-extrusion, compression molding, injection molding, or the like. These conductive loaded resin-based material antenna elements 412 having a conducting wire center can also be fabricated by ultrasonic insertion of the conducting wire, insertion molding, or over-molding. The conducting wire center core enhances the performance of the antenna elements 412 and simplifies the connection of an antenna element to an electrical signal wire or to other antenna elements. As shown in FIG. 5 the center core wire 402 can protrude beyond the ends of the conductive loaded resin-based material 402.

FIG. 6 shows a longitudinal cross section view of the antenna element 412 shown in FIG. 5 showing the wire core 400 surrounded by the conductive loaded resin-based material 402. FIG. 6 shows a non-insulated single strand wire center 400; however, as shown in FIGS. 7A–7D, the wire center 400 can be single strand, multi-strand, insulated, or non-insulated wire. FIG. 7A shows a transverse cross section view of the antenna element 412 shown in FIG. 5 for an antenna element having a circular cross section and a single strand, non-insulated wire center. FIG. 7B shows a transverse cross section view of the antenna element 412 shown in FIG. 5 for an antenna element having a circular cross section and a single strand, insulated wire center 400 with a layer of insulation 403 between the single strand wire center 400 and the conductor loaded resin-based material 402. FIG. 7C shows a transverse cross section view of the antenna element 412 shown in FIG. 5 for an antenna element having a circular cross section and a multi-strand, non-insulated wire center. FIG. 7D shows a transverse cross section view of the antenna element 412 shown in FIG. 5 for an antenna element having a circular cross section and a multi-strand, insulated wire center 400 with a layer of insulation 403 between the multi-strand wire center 400 and the conductor loaded resin-based material 402. The antenna elements formed in this manner can have any desired cross section shapes. As an example, FIG. 8 shows a transverse cross section view of the antenna element 412 shown in FIG. 5 for an antenna element having a rectangular cross section. Other cross section shapes can also be used.

Figure 9:
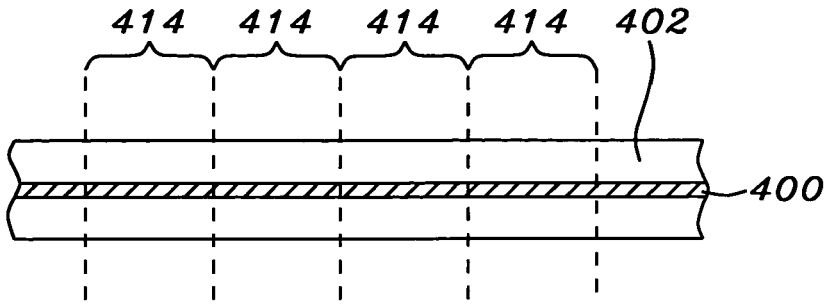
FIG. 9 shows a cross section view of a length of conductive loaded resin-based material having a conducting wire center which can be cut into individual antenna elements.

As shown in FIG. 9 the antenna elements can be fabricated by forming a long segment of conductive loaded resin-based material 402 having a conducting wire center 400. Individual antenna elements 414 can then be cut from the long segment.

Figure 10:
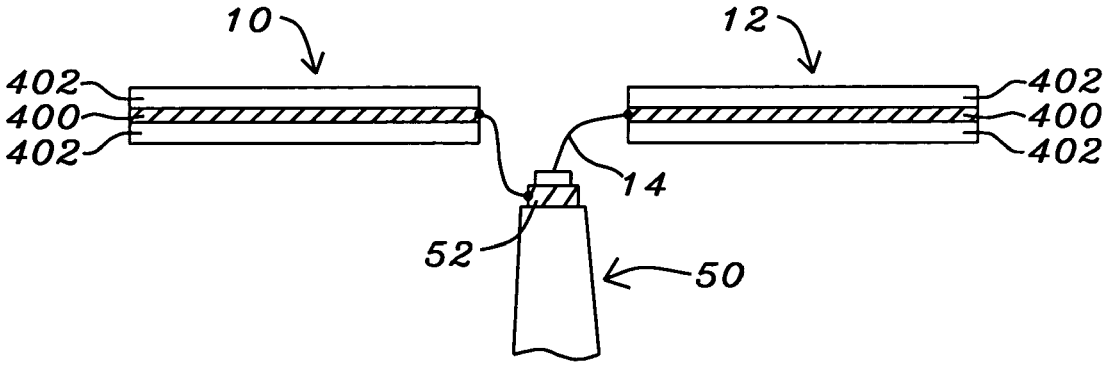
FIG. 10 shows a cross section view of a dipole antenna having antenna elements formed from conductive loaded resin-based material having a conducting wire center.

FIG. 10 shows a cross section view of a dipole antenna with a radiating or receiving antenna element 12 and a counterpoise antenna element 10 formed from conductive loaded resin-based materials 402 having a conducting wire center 400. The antenna comprises a radiating or receiving antenna element 12 and a counterpoise antenna element 10 each having a length and a cross section perpendicular to the length. Typically the length is greater than three multiplied by the square root of the cross sectional area. The center conductor 14 of a coaxial cable 50 is electrically connected to the conducting wire center 400 of the radiating or receiving antenna element 12. The shield 52 of the coaxial cable 50 is electrically connected to the conducting wire center 400 of the counterpoise antenna element 10. The length of the transmitting or receiving antenna element 12 is the same as the counterpoise antenna element 10 and is a multiple of a quarter wavelength of the optimum frequency of detection or transmission of the antenna. The impedance of the antenna at resonance should be very nearly equal to the impedance of the coaxial cable 50 to assure maximum power transfer between cable and antenna.

Figure 11:
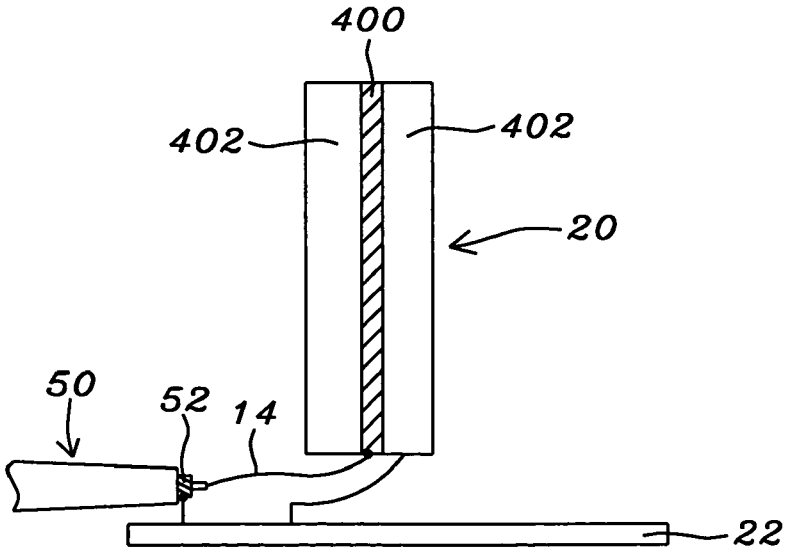
FIG. 11 shows a cross section view of a monopole antenna having an antenna element formed from conductive loaded resin-based material having a conducting wire center.

FIG. 11 shows an example of a monopole antenna having a radiating or receiving antenna element 20 formed of conductive loaded resin-based material 402 having a conducting wire center 400. The radiating or receiving antenna element 20 is arranged perpendicular to a ground plane 22. The radiating or receiving antenna element 20 is electrically insulated from the ground plane 22. The ground plane 22 can be any suitable conductor and can be metal or conductive loaded resin-based material. The height of the radiating or receiving antenna element 20 is greater than three times the square root of the cross sectional area of the radiating or receiving antenna element 22. The center conductor 14 of a coaxial cable 50 is electrically connected to the conducting wire center 400 of the radiating or receiving antenna element 402. The shield 52 of the coaxial cable 50 is electrically connected to the ground plane 22. The length of the transmitting or receiving antenna element 402 is a multiple of a quarter wavelength of the optimum frequency of detection or transmission of the antenna. The impedance of the antenna at resonance should be very nearly equal to the impedance of the coaxial cable 50 to assure maximum power transfer between cable and antenna.

Although the examples shown in FIGS. 5, 6, and 8–11 show a single strand, non-insulated conducting wire center; single strand, insulated wire; multi-strand, non-insulated wire; and/or multi-strand insulated wire can also be used as the conducting wire center; as shown in FIGS. 7A–7D.

While the invention has been particularly shown and described with reference to the preferred embodiments thereof, it will be understood by those skilled in the art that various changes in form and details may be made without departing from the spirit and scope of the invention.

What is claimed is:

1. An antenna comprising:

a number of antenna elements, wherein said antenna elements comprise a conducting metal wire having an outer jacket of conductive loaded resin-based material around said conducting metal wire, and wherein said conductive loaded resin-based material comprises micron conductor powders, micron conductor fibers, or a combination of said micron conductor powders and said micron conductor fibers homogenized within a base resin host and wherein the ratio of the weight of said micron conductor powders, said micron conductor fibers, or said combination of said micron conductor powders and said micron conductor fibers to the weight of said base resin host is between about 0.20 and 0.40; and electrical continuity to and among said antenna elements.

2. The antenna of claim 1 wherein said conducting metal wire is a non-insulated, single strand wire.

3. The antenna of claim 1 wherein said conducting metal wire is an insulated, single strand wire having a layer of insulation between said single strand wire and said outer jacket of conductive loaded resin-based material.

4. The antenna of claim 1 wherein said conducting metal wire is a non-insulated, multi-strand wire.

5. The antenna of claim 1 wherein said conducting metal wire is an insulated, multi-strand wire having a layer of insulation between said multi-strand wire and said outer jacket of conductive loaded resin-based material.

6. The antenna of claim 1 wherein said micron conductor powders comprise micron conductor particles having generally spherical shapes and diameters of between about 3 and 12 microns.

7. The antenna of claim 1 wherein said micron conductor fibers have diameters of between about 3 and 12 microns.

8. The antenna of claim 1 wherein said micron conductor fibers have lengths of between about 2 and 14 millimeters.

9. The antenna of claim 1 wherein said micron conductor powders comprise micron conductor particles and wherein said particles are stainless steel, nickel, copper, silver, carbon, graphite, or plated particles.

10. The antenna of claim 1 wherein said micron conductor fibers are stainless steel, nickel, copper, silver, carbon, graphite, or plated fibers.

11. The antenna of claim 1 wherein said conducting metal wire is copper, nickel, stainless steel, or silver.

12. The antenna of claim 1 wherein the antenna comprising said number of antenna elements is designed for frequencies between about 2 Kilohertz and 300 Gigahertz.

13. The antenna of claim 1 wherein said antenna is a dipole antenna and said number of antenna elements is two antenna elements.

14. The antenna of claim 1 wherein said antenna is a monopole antenna and said number of antenna elements is one antenna element.

15. The antenna of claim 1 wherein said antenna is a monopole antenna, said number of antenna elements is one antenna element, and said antenna element is disposed perpendicular to a ground plane.

16. The antenna of claim 1 wherein said antenna can be a transmitting antenna, a receiving antenna, or both a transmitting antenna and a receiving antenna.

17. A method of fabricating an antenna, comprising:

fabricating a number of antenna elements, wherein said antenna elements comprise a conducting metal wire having an outer jacket of conductive loaded resin-based material around said conducting metal wire, and wherein said conductive loaded resin-based material comprises micron conductor powders, micron conductor fibers, or a combination of said micron conductor powders and said micron conductor fibers homogenized within a base resin host, and wherein the ratio of the weight of said micron conductor powders, said micron conductor fibers, or said combination of said micron conductor powders and said micron conductor fibers to the weight of said base resin host is between about 0.20 and 0.40; and making electrical connections to and among said antenna elements.

18. The method of claim 17 wherein said conducting metal wire is a non-insulated, single strand wire.

19. The method of claim 17 wherein said conducting metal wire is an insulated, single strand wire having a layer of insulation between said single strand wire and said outer jacket of conductive loaded resin-based material.

20. The method of claim 17 wherein said conducting metal wire is a non-insulated, multi-strand wire.

21. The method of claim 17 wherein said conducting metal wire is an insulated, multi-strand wire having a layer of insulation between said multi-strand wire and said outer jacket of conductive loaded resin-based material.

22. The method of claim 17 wherein said micron conductor powders comprise micron conductor particles having generally spherical shapes and diameters of between about 3 and 12 microns.

23. The method of claim 17 wherein said micron conductor fibers have diameters of between about 3 and 12 microns.

24. The method of claim 17 wherein said micron conductor fibers have lengths of between about 2 and 14 millimeters.

25. The method of claim 17 wherein said micron conductor powders comprise micron conductor particles and wherein said particles are stainless steel, nickel, copper, silver, carbon, graphite, or plated particles.

26. The method of claim 17 wherein said micron conductor fibers are stainless steel, nickel, copper, silver, carbon, graphite, or plated fibers.

27. The method if claim 17 wherein said conducting metal wire is copper, nickel, stainless steel, or silver.

28. The method of claim 17 wherein the antenna comprising said number of antenna elements is designed for frequencies between about 2 Kilohertz and 300 Gigahertz.

29. The method of claim 17 wherein said antenna is a dipole antenna and said number of antenna elements is two antenna elements.

30. The method of claim 17 wherein said antenna is a monopole antenna and said number of antenna elements is one antenna element.

31. The method of claim 17 wherein said antenna is a monopole antenna, said number of antenna elements is one antenna element, and said antenna element is disposed perpendicular to a ground plane.

32. The method of claim 17 wherein said antenna can be a transmitting antenna, a receiving antenna, or both a transmitting antenna and a receiving antenna.

33. The method of claim 17 wherein said antenna elements are fabricated by extrusion or co-extrusion molding said conductor loaded resin-based materials around said conducting wire.

34. The method of claim 17 wherein said antenna elements are fabricated by molding said conductor loaded resin-based materials around said conducting wire.

35. The method of claim 17 wherein said fabricating said number of antenna elements comprises molding a length of said conducting metal wire having said outer jacket of conductive loaded resin-based material around said conducting metal wire and cutting said length of said conducting metal wire having said outer jacket of conductive loaded resin-based material around said conducting metal wire into a number of sub-lengths wherein each of said sub-lengths is an antenna element.

* * * * *